US005630558A

United States Patent [19]

Nitta et al.

[11] Patent Number: 5,630,558

[45] Date of Patent: May 20, 1997

[54] WEAR PROTECTIVE MEANS

[75] Inventors: Sachihito Nitta, Yao; Shigetoshi Kawabata, Kashiwa, both of Japan

[73] Assignee: Kubota Corporation, Osaka, Japan

[21] Appl. No.: 550,113

[22] Filed: Oct. 30, 1995

[51] Int. Cl.[6] ..... B02C 17/22

[52] U.S. Cl. ..... 241/172; 241/182

[58] Field of Search ..... 241/172, 275, 241/285.1, 300, 182, 183

[56] References Cited

U.S. PATENT DOCUMENTS 5,346,146 9/1994 Nitta ..... 241/172

FOREIGN PATENT DOCUMENTS 44-29838 12/1969 Japan .
4-37541 3/1992 Japan .
5-329696 12/1993 Japan .
5-329393 12/1993 Japan .
5-337388 12/1993 Japan .

*Primary Examiner*—Mark Rosenbaum
*Attorney, Agent, or Firm*—Wenderoth, Lind & Ponack

[57] ABSTRACT

A shelf for protecting the inner surface of a vertical shell of a pulverizer against wear. It is partially replaceable. The shell accommodates a screw shaft and is filled with a pulverizing medium and a material to be pulverized. At least one of them is magnetizable. The shelf is made up of vertical and circumferential ribs and mounted in the shell. It is divided both vertically and circumferentially into a plurality of blocks that are coupled together by bolts and nuts. Magnets are provided in the spaces defined by the ribs. By turning the screw shaft, the pulverizing medium is pushed radially outward and partially trapped in the above spaces, thus forming a wear protective lining. When any of the ribs is worn, only the block that includes this rib is replaced with a new one.

8 Claims, 6 Drawing Sheets

WEAR PROTECTIVE MEANS

BACKGROUND OF THE INVENTION

This invention relates to a protective means for preventing wear of the inner surface of a shell of a vertical pulverizer for pulverizing a material into powder or particles by stirring it with a pulverizing medium.

FIG. 1 shows a vertical pulverizer of this type. It has a vertical shell 1 which accommodates a vertical screw shaft 2 and is filled with pulverizing medium b such as steel balls. A material a is put into the shell 1 with the screw shaft 2 in rotation. The material a flows up and down together with the pulverizing medium b in the shell, so that it is pulverized into minute particles c by friction between individual pieces of the material and between the material and the medium. The particles c thus obtained are carried out of the shell 1 by a carrier fluid d such as air or water.

Due to the movement of the material and the pulverizing medium in the shell 1, its inner surface is subjected to a large frictional force. Thus, it is necessary to provide the inner surface of the shell with some kind of wear protective means. Such wear protective means are disclosed in Unexamined Japanese Patent Publication 5-329393 and Examined Japanese Patent Publication 44-29838. A wear protective means of the type disclosed in these publications is shown in FIG. 6. It comprises vertical ribs or rods 21 and circumferential ribs or shelf boards 22. Pulverizing medium trapped in the spaces defined by the ribs 22 and 21 covers and protects the inner surface of the shell 1 like a lining.

This wear protective means is constructed first by providing rods 21 to cover the entire length of a portion of the inner surface of the shell 1 that needs protection against wear. Then, shelf boards 22 and cylindrical sheaths 23 are fitted on the rods 21 from bottom to top. The rods 21, shelf boards 22 and sheaths 23 are made of a wear-resistant alloy, a wear-resistant rubber or a ceramic material.

Though the pulverizing medium b trapped in the protective structure serves as a wear protective lining, the shelf boards 22 and the sheaths 23 inevitably get worn gradually as the pulverizer is operated for a long time. When they are worn to a certain degree, they have to be replaced with new ones. For this purpose, all the shelf boards 22 and the sheaths 23 have to be removed from the rods from top to bottom, and then new shelf boards and sheaths have to be fitted on the rods from bottom to top. This work is extremely troublesome.

Thus, worn shelf boards 22 and sheaths 23 are often left unreplaced. But worn shelf boards 22 can come off easily, making it increasingly difficult to trap the pulverizing medium b to form a wear protective lining. Without the wear protective lining, the inner surface of the shell 1 will be worn so quickly that the shell 1 may be prematurely damaged to such an extent that it needs massive repairs.

SUMMARY OF THE INVENTION

An object of this invention is to provide a wear protective means for a pulverizer in which only worn parts can be replaced.

According to this invention, there is provided a wear protective means in the form of a shelf for protecting the inner surface of a vertical shell of a pulverizer by forming a lining layer of pulverizing medium. The shelf is divided vertically and circumferentially into a plurality of blocks that are coupled together so that any one of the blocks can be individually replaced with a new block.

When any one of the ribs is worn, only the block that includes this rib can be replaced with a new one. Thus, the shelf can be repaired easily in a short time.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
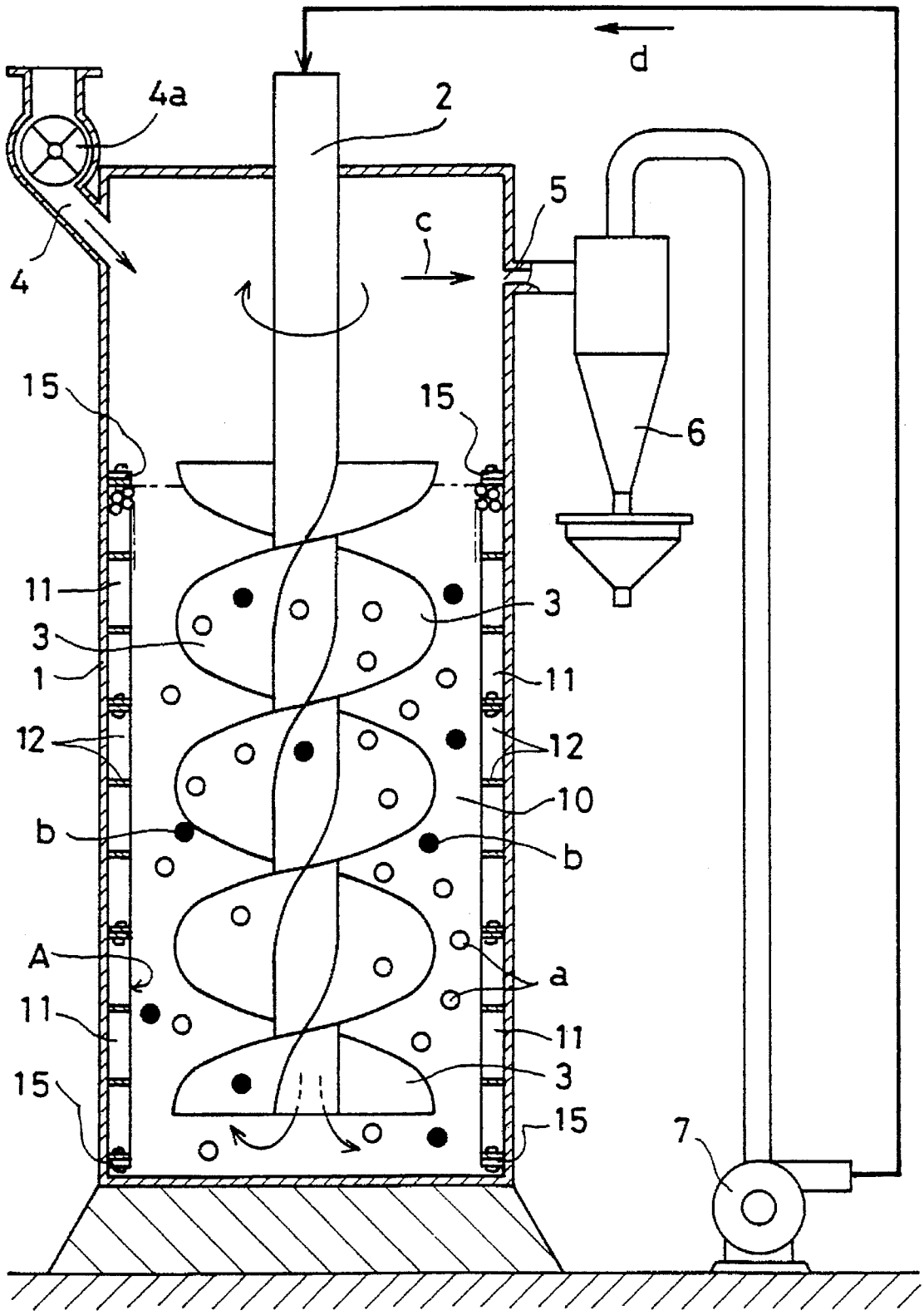
FIG. 1 is a schematic sectional view of an embodiment of the invention.

The pulverizer shown in FIG. 1 comprises a vertical cylindrical shell 1 accommodating a screw shaft 2 extending along the axis of the shell 1 and having two rows of screw blades 3. An inlet 4 for material a and an outlet (exhaust port) 5 for particles c are provided at an upper part of the shell 1. A rotary valve 4*a* is provided at the inlet 4 to feed the material in a substantially airtight condition. An air suction fan 7 is connected to the outlet 5 through a particle trap 6 such as a bag filter or a cyclone. Air d is circulated through the hollow screw shaft 2, shell 1 and trap 6 by the fan 7.

Figure 2:
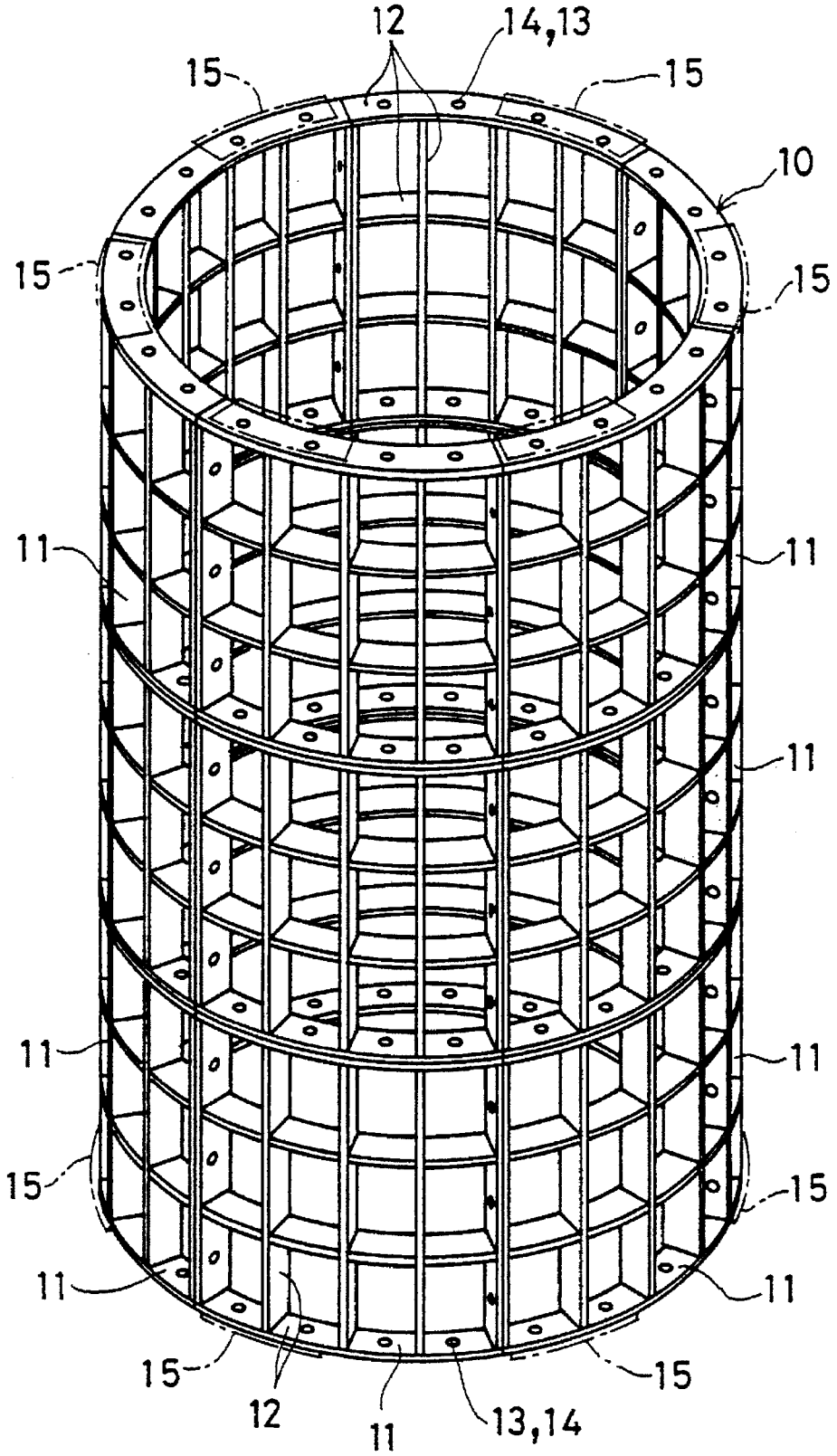
FIG. 2 is a schematic perspective view of a shelf.

As shown in FIGS. 1 and 2, a shelf 10 is provided in the shell 1 so as to cover its inner surface. Its top end is at a level substantially equal to the highest level a fluidic layer of the pulverizing medium b reaches in pulverizing operation. The shelf 10 is divided vertically into three sections and circumferentially into six sections. Namely, it is formed by coupling eighteen blocks 11 shown in FIG. 3. But it may be divided differently according to the size of the shell 1, degree of wear and/or workability, which will be discussed later.

Figure 3:
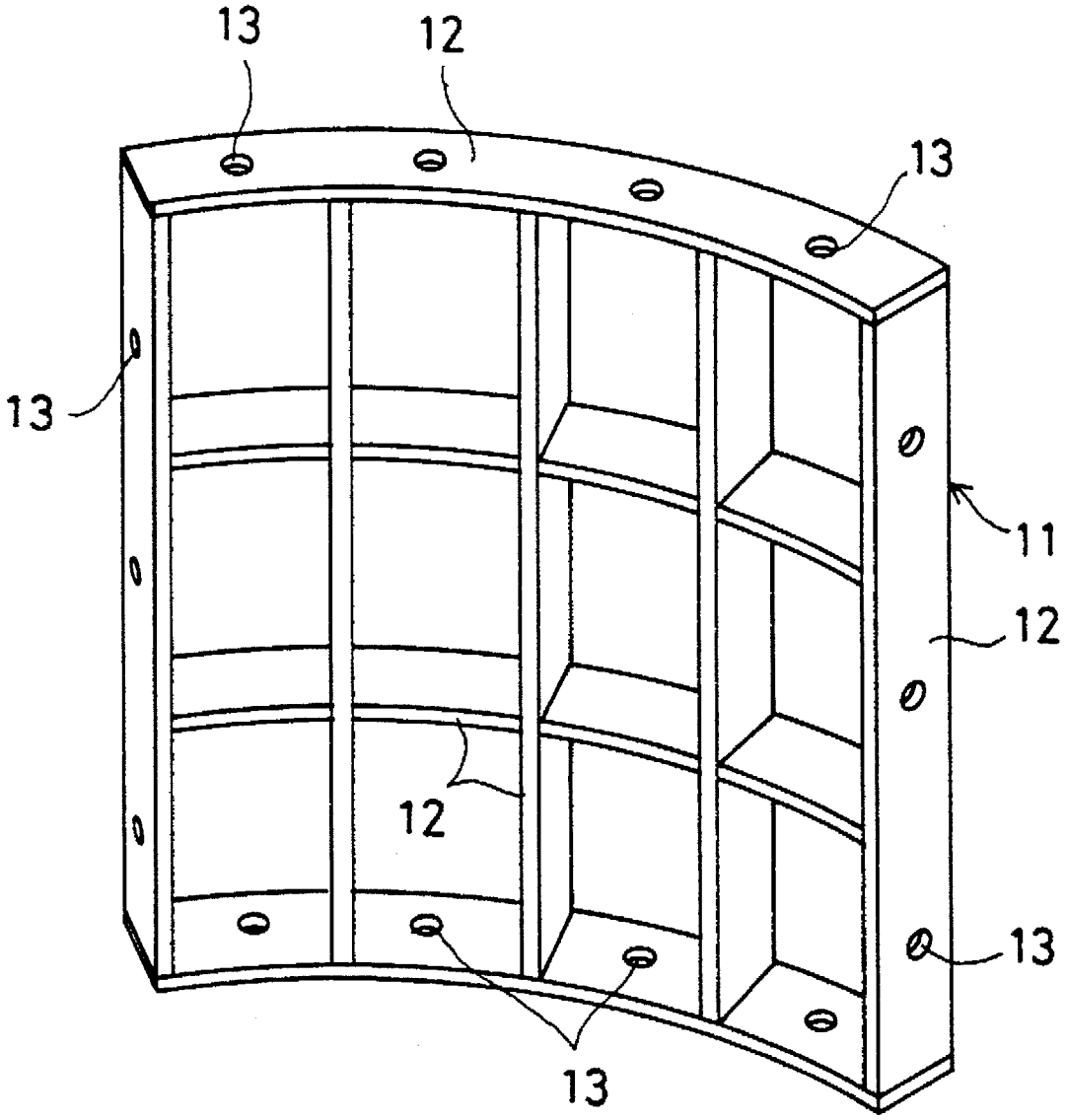
FIG. 3 is a perspective view of a block of the shelf.
Figure 6:
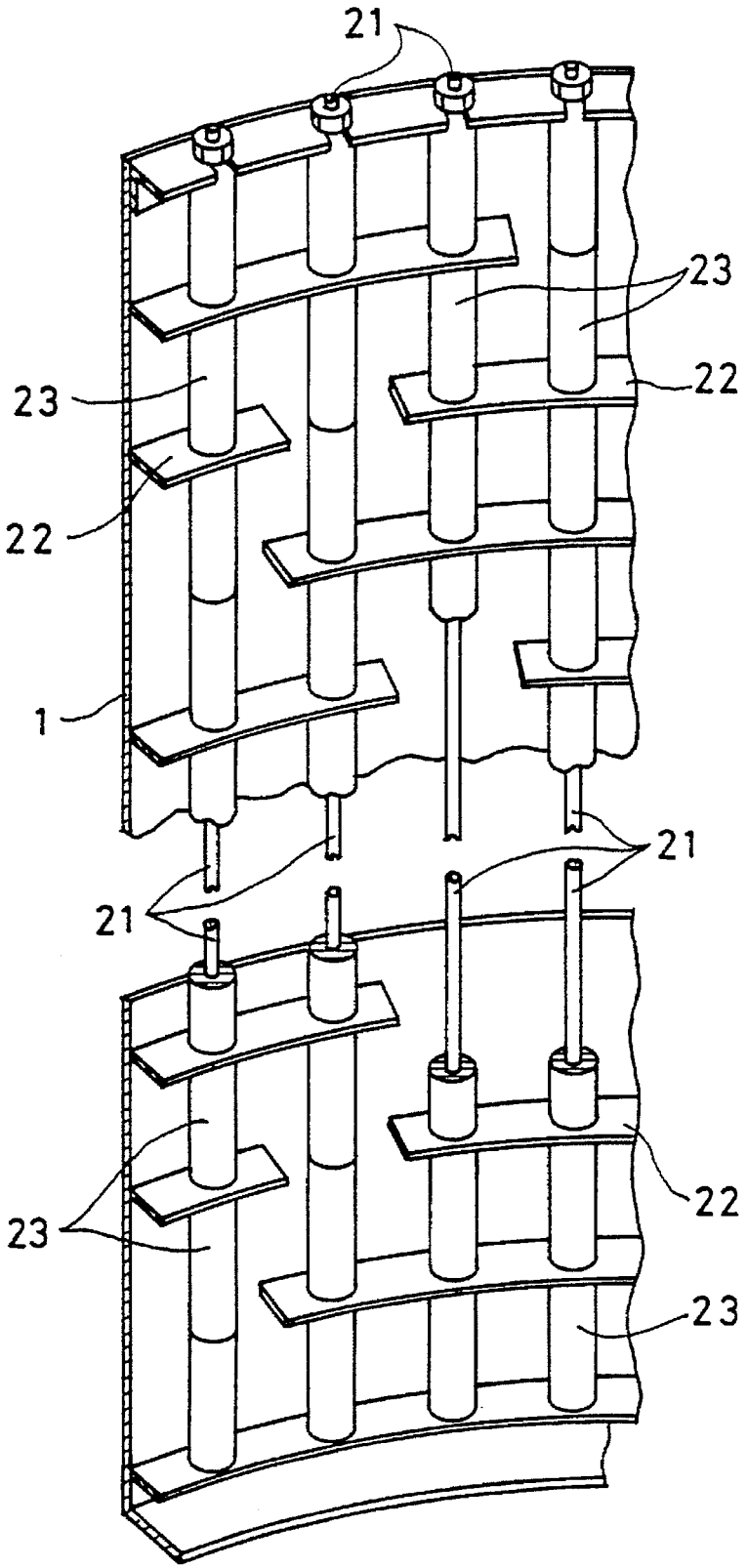
FIG. 6 PRIOR ART
FIG. 6 is a partial, schematic perspective view of a conventional shelf.

Referring to FIG. 3, each block 11 has a lattice structure comprising vertical and circumferential rib plates 12. But it need not have a complete lattice shape. Namely, the rib plates 12 may be partially missing as shown in FIG. 6. They should be made of a wear-resistant material such as a wear-resistant alloy, wear-resistant rubber or ceramics.

Figure 4:
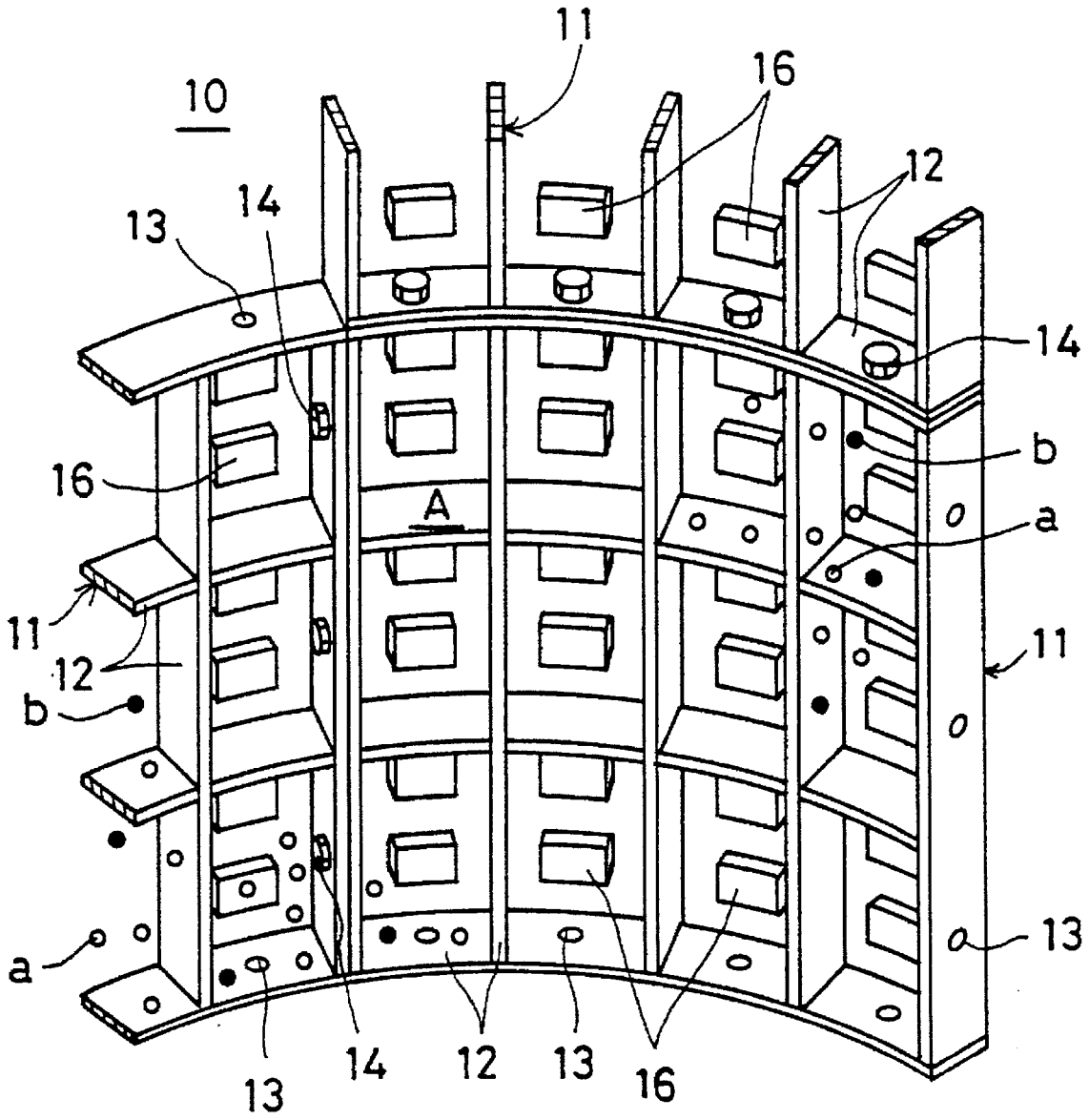
FIG. 4 is a perspective view of a portion of the embodiment.

The blocks 11 have through holes 13 in the top, bottom and both side plates. As shown in FIG. 4, they are coupled together by arranging them side by side or one upon the other, inserting bolts 14 through the holes 13 of the adjacent blocks 11, and tightening the bolts with nuts. The shelf 10 thus assembled is fixed at its top and bottom to ribs 15 fixed to the shell 1 by bolts and nuts 14 (see FIG. 1). Otherwise, each block 11 may be individually bolted to ribs fixed to the shell. The ribs 15 may be bolted, welded or otherwise fixed to the inner surface of the shell 1.

Figure 5A:
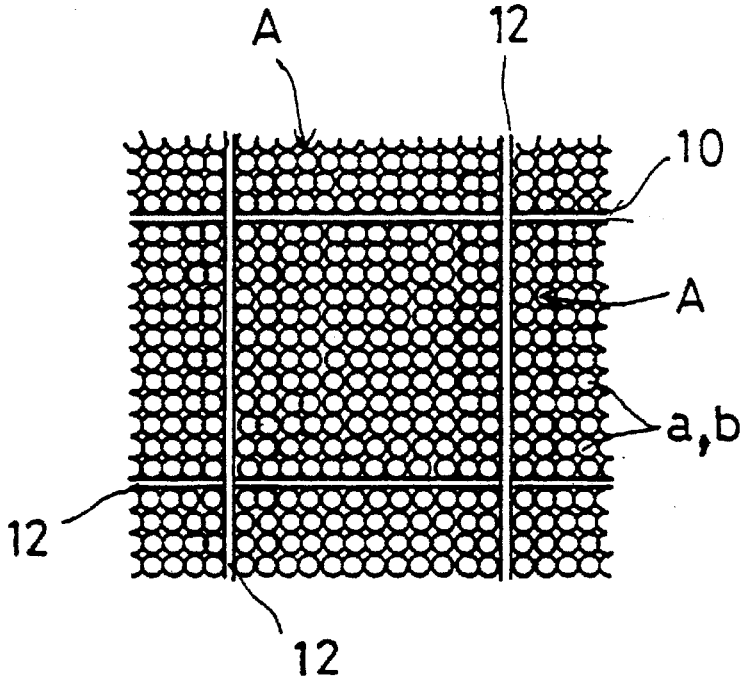
FIGS. 5A and 5B are a front view and a side view of a portion of the embodiment, explaining its operation.
Figure 5B:
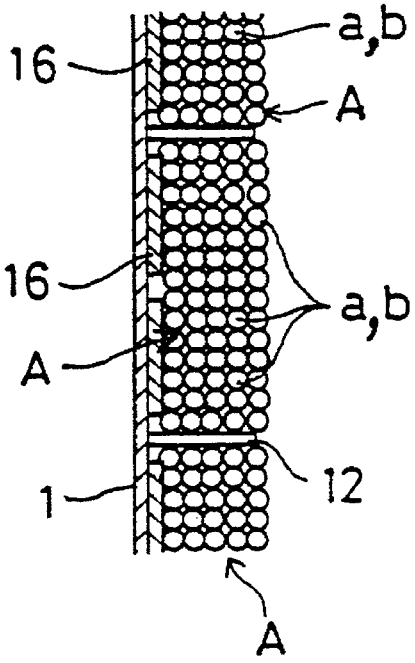

After setting up the shelf 10 in the shell 1, as shown in FIG. 4, magnets 16 are attached to the inner surface of the shell 1 (in the spaces defined by the rib plates 12) as disclosed in Unexamined Japanese Patent Publication 5-329696. If the pulverizing medium b is steel balls, in the operation of the pulverizer, they will be trapped in the spaces defined by the rib plates 12 and will be attracted to the magnets 16, thus forming a self-lining layer A shown in FIG. 5. Since the surface of this lining A is flush with or protrudes from the front edges of the rib plates 12, it is possible to limit the wear of the rib plates 12 to a minimum. But the magnets 16 may be omitted.

When the shelf 10 is partially worn, just the block 11 including the worn part can be replaced with a new one, which is prepared beforehand, by removing the bolts and nuts 14. Thus, the shelf 10 can be repaired easily in a short time. The conventional wear protective structure shown in FIG. 6 has to be entirely replaced with a new one in a year or two. In contrast, with the wear protective structure according to the invention, such entire replacement is not necessary until more than five years elapse.

In the present invention, air is used as the carrier fluid d. But it may be a gas other than air or may be a liquid such as water (as disclosed in Unexamined Japanese Utility Model Publication 4-37541). Also, as is well-known in the art, the carrier fluid may be introduced into the shell 1 through an inlet formed in the center of its bottom or in the bottom portion of its side wall (as disclosed in Unexamined Japanese Patent Publication 5-337388).

In the present invention, because the shelf forming the self-lining layer is of a divided structure, only the worn portion can be replaced with a new one. This leads to savings in work hours.

What is claimed is:

1. A pulverizing apparatus, comprising:

a vertical shell for accommodating a material to be pulverized and a pulverizing medium, said vertical shell having an inner surface;

a vertical screw shaft provided in said vertical shell; and a wear protective means for protecting said vertical shell from wear, said wear protective means comprising a lattice-shaped shelf mounted on said inner surface of said vertical shell having a plurality of vertical and circumferential ribs, and said shelf being divided vertically and circumferentially into a plurality of blocks that are coupled together so that each of said blocks can be individually replaced with a new block, whereby pulverizing medium trapped in spaces defined by said ribs forms a lining layer covering said inner surface of said vertical shell.

2. The pulverizing apparatus of claim 1, wherein said vertical shell has a inlet therein for the material to be pulverized and an outlet for the material after it has been pulverized.

3. The pulverizing apparatus of claim 1, wherein said shelf is cylindrical in form and is mounted to ribs on said inner surface of said vertical shell.

4. The pulverizing apparatus of claim 3, wherein said blocks are coupled together by bolts.

5. A pulverizing apparatus, comprising:

a vertical shell for accommodating a material to be pulverized and a pulverizing medium, said vertical shell having an inner surface;

a vertical screw shaft provided in said vertical shell; and a lattice shelf mounted on said inner surface of said vertical shell having a plurality of vertical and circumferential ribs, said shelf being divided vertically and circumferentially into a plurality of blocks that are coupled together so that each of said blocks can be individually replaced with a new block.

6. The pulverizing apparatus of claim 5, wherein said vertical shell has an inlet therein for the material to be pulverized and an outlet for the material after it has been pulverized.

7. The pulverizing apparatus of claim 5, wherein said shelf is cylindrical in form and is mounted to ribs on said inner surface of said vertical shell.

8. The pulverizing apparatus of claim 5, wherein said shelf defines a means for trapping pulverizing material and forming a lining layer covering said inner surface of said vertical shell.

* * * * *